United States Patent [19]

King et al.

[11] 4,191,865

[45] Mar. 4, 1980

[54] LOUDSPEAKER PADRING AND METHOD OF MAKING THE SAME

[75] Inventors: John A. King, Mentor; Douglas W. O'Brien, Rocky River, both of Ohio

[73] Assignee: Essex Group, Inc., Fort Wayne, Ind.

[21] Appl. No.: 950,934

[22] Filed: Oct. 12, 1978

[51] Int. Cl.[2] ..... H04R 1/00; H04R 9/02

[52] U.S. Cl. ..... 179/178; 179/115.5 R; 181/171

[58] Field of Search ..... 29/594; 179/115.5 R, 179/178, 179; 181/148, 167, 171, 172; 156/244.22, 309; 264/37; 277/166, DIG. 6.

[56] References Cited

U.S. PATENT DOCUMENTS

| | | | |
|---|---|---|---|
| 2,829,728 | 4/1958 | Brown | 181/149 |
| 3,404,053 | 10/1968 | Tokuma et al. | 29/594 |
| 3,603,427 | 9/1971 | Sotome et al. | 181/167 |
| 3,778,562 | 12/1973 | Wright | 181/148 |
| 3,801,406 | 4/1974 | Debenedetti | 264/37 |
| 3,892,289 | 7/1975 | Rollins | 181/171 |
| 4,145,465 | 3/1979 | Sanderson et al. | 156/309 |

FOREIGN PATENT DOCUMENTS

| | | | |
|---|---|---|---|
| 463937 | 7/1928 | Fed. Rep. of Germany | 179/111 R |
| 1161591 | 1/1964 | Fed. Rep. of Germany | 179/111 R |
| 370248 | 4/1932 | United Kingdom | 179/111 R |

*Primary Examiner*—George G. Stellar
*Attorney, Agent, or Firm*—Lawrence E. Freiburger; Robert D. Sommer

[57] ABSTRACT

A padring for a loudspeaker is formed of a hot melt type material. The padring is easily attached to the housing by applying heat and also serves as a means of attaching a screen to the speaker. In the method of forming the padring, the hot melt type material is extruded into a continuous flat sheet and the padrings are cut from the sheet. Any scrap formed when the padrings are cut from the sheet can be recycled to the extruder reservoir since the hot melt material exhibits little thermal degradation. Consequently, the method of manufacturing the padring of the invention is a scrapless method.

16 Claims, 2 Drawing Figures

LOUDSPEAKER PADRING AND METHOD OF MAKING THE SAME

BACKGROUND OF THE INVENTION

Loudspeaker gaskets, sometimes known as padrings, have been used to effect a suitable seal between the loudspeaker housing and the baffle upon which it is mounted. The most common materials from which loudspeaker padrings are constructed are laminated paper products commonly known as chipboard and a compressed fiber product commonly known as bindersboard. Generally, the padring is die cut from a sheet of the desired material and adhesively bonded to the loudspeaker housing and cone assembly. Scrap resulting from the padring manufacture process is discarded.

It is well known by those skilled in the art that chipboard and bindersboard padrings have many undesirable properties but their use has been continued for lack of an economically feasible substitute material. For example, both chipboard and bindersboard have a tendency to absorb water and are not dimensionally stable under varying environmental conditions.

Alternate materials have been proposed but have not been widely accepted because they each possess one or more undesirable properties. For example, die cut sponge rubber or foamed plastics have been proposed but since they are expensive due to the substantial scrap wasted, they have not gained acceptance. Likewise, injection molded plastic foams have been proposed, but due to the expensive mold cost and mold cycle time for injection molding, the end cost is relatively expensive. Accordingly, injection molded foam padrings have not gained wide acceptance either.

SUMMARY OF THE INVENTION

The present invention provides a padring and method for making it which overcomes many of the disadvantages of prior art padrings. More specifically, the padring of the present invention can be produced in quantities for approximately the same cost as the present chipboard or bindersboard padrings but yet remains dimensionally stable under the varying environmental conditions to which a loudspeaker may be subjected. This property alone, should be sufficient to enable the padring of the invention to gain widespread acceptance within the loudspeaker industry. However, the padring of the invention has the additional advantageous property that it is constructed of an adhesive material so that it is not necessary to use a separate adhesive to attach the padring of the invention to the loudspeaker housing or to attach a screen to the loudspeaker.

More particularly, the padring of the invention is constructed of a hot metal type material which is normally formulated and used in adhesive bonding applications. Although the hot melt type material is more expensive than chipboard or bindersboard per unit volume, the hot melt material can be utilized in the scrapless forming method of the invention with relatively simple tooling to produce padrings for approximately the same unit cost as chipboard or bindersboard padrings. The hot melt type material is a blend of hydrocarbons, microcrystalline waxes and tackifiers formulated in the proper proportions to give a final product of the desired properties.

In the fabrication method of the invention, the hot melt adhesive is extruded into a continuous sheet of the desired thickness and the padrings are die cut from the continuous sheet after it has hardened. Because the hot melt type material suffers relatively little thermal degradation, the scrap which remains after the padrings have been cut from the extruded strip can be returned to the extruder reservoir, thus resulting in a scrapless formation process.

BRIEF DESCRIPTION OF THE DRAWINGS

In the course of the detailed description of the invention, reference will be made to the drawings, in which.

DETAILED DESCRIPTION OF THE DRAWING FIGURES

Figure 1:
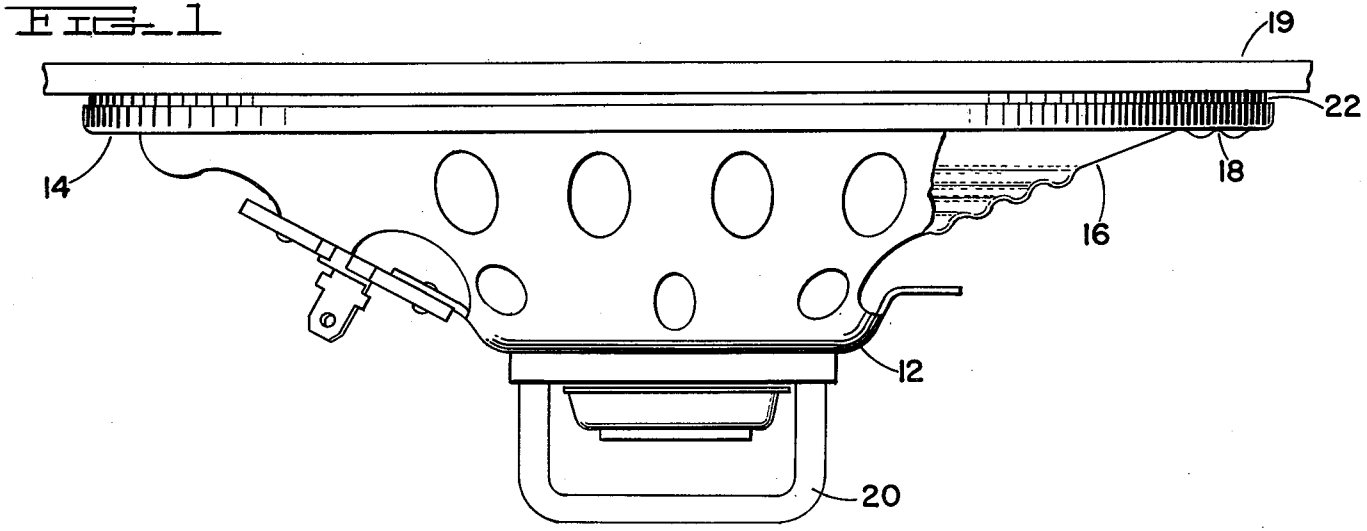
FIG. 1 is an elevational view of a loudspeaker having a padring in accordance with the present invention adhered thereto.

Referring now to the drawing FIGURES, and more particularly, to FIG. 1, a loudspeaker assembly in accordance with the present invention includes a substantially conically shaped basket or housing 12 having an annular rim 14 at its larger end. A substantially conically shaped diaphragm 16 is suitably suspended from the annular rim 14 by an annular compliant suspension 18 which may be unitary with the diaphragm or separate therefrom. Mounted on the smaller end of the basket is a driver assembly 20 which is interconnected with the diaphragm to cause movement thereof. The assembly thus far described is conventional.

In accordance with the present invention, a padring 22 (gasket) made of hot melt type material is adhered to the basket rim 14 and suspension 18. When the loudspeaker is secured to a baffle 19, the padring 22 makes a suitable seal with the baffle.

The hot melt type material is one of the many hot melt formulations on the market used for their adhesive properties. Although it has been known for many years that a hot melt type material suffers little thermal degradation as it is remelted many times, applications for use of hot melt type materials have been substantially restricted to adhesive uses. The preferable hot melt formulation is one that undergoes little thermal degradation, has a melting point low enough to allow the surface of hot melt material to be melted without destroying the other loudspeaker components, is tacky enough to adhere to the diaphragm and basket after the surface is melted, and can be used with extruding equipment as will hereinafter be described. A suitable hot melt type material has been found to be a blend of hydrocarbon polymers, tackifiers, and waxes. More particularly, a suitable hot melt type material is available from H. B. Fuller and sold under the formulation no. E 5037.

Figure 2:
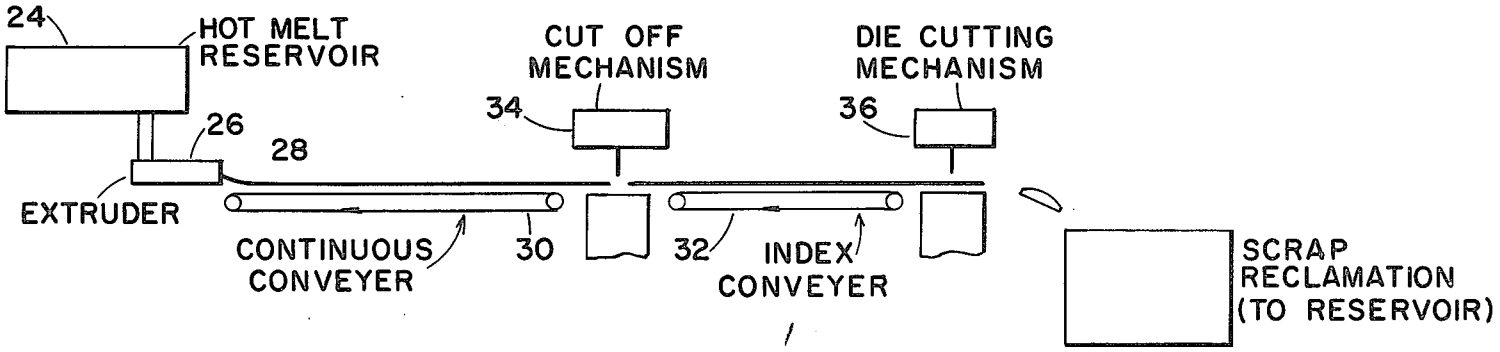
FIG. 2 is a schematic view of the method by which the padrings of the invention are made.

The preferable method of making the loudspeaker padring gasket of the invention is schematically depicted in FIG. 2. Preferably, the hot melt type material is retained in a heated reservoir 24 which supplies melted material to an extruder 26 which extrudes the material into a flat continuous sheet 28 onto a moving conveyor 30. Preferably, conveyor 30 is constructed of stainless steel to provide a heat sink for the extruded strip so that it cools as rapidly as possible. After the conveyor 30, the extruded strip passes onto an index conveyor 32. A cutoff mechanism 34 is employed between conveyors 30 and 32 to sever the extruded strip. The index conveyor is operated at a slightly higher speed than conveyor 30 to ensure that the cutoff portion of the strip is separated from the strip. At the end of the index conveyor 32 is a blanking die assembly 36 which causes a blanking die to die cut suitable padrings from the extruded strip. Scrap material remaining after the padrings have been die cut from the strip is returned to the extruder reservoir since the hot melt material undergoes very little thermal degradation.

Having disclosed the structure of the padring of the invention and the method for making it, the advantages of the padring of the invention will be immediately obvious to those skilled in the art. Inasmuch as the padring is constructed of hot melt type material, the padring of the invention not only provides the same function as prior art padrings, but also does not need any additional adhesive material to be attached to the basket and diaphragm. If desired, the annular rim on the basket can be magnetic induction heated to melt the padring surface and then attach it to the housing without damaging other loudspeaker components. Further, a screen such as is applied to automotive type speakers may be bonded to the padring with a small amount of localized heating.

The preferred form of the invention has been described in the foregoing specification. Obvious modifications and alternations will occur to those skilled in the art. Accordingly, it is intended that the scope of the invention be defined in the claims as broadly as prior art permits.

What is claimed is:

1. In a loudspeaker assembly having a frame upon which the loudspeaker components are mounted and by which said loudspeaker is mounted on a baffle, and an improved padring gasket carried on said frame and situated between said frame and baffle, wherein said improved padring gasket is formed from a hot melt type material.

2. The loudspeaker assembly as claimed in claim 1, wherein said hot melt material is a polymer based hot melt material.

3. The loudspeaker assembly as claimed in claims 1 or 2, wherein said hot melt material has adhesive properties.

4. The loudspeaker assembly as claimed in claims 1 or 2 wherein said hot melt material comprises a blend of hydrocarbon polymers, tackifiers and waxes.

5. A loudspeaker mounting, comprising:

a mounting wall having an aperture therein;

a loudspeaker assembly having a housing with a flanged rim, said flanged rim including a generally planar annular surface around the periphery of said housing, the plane defining said generally planar annular surface being substantially perpendicular to the axis of said loudspeaker, and an integral flange extending from the edge of said planar, annular surface; and a unitary adhesive gasket comprised of hot melt type material interposed between said rim and said wall.

6. The loudspeaker mounting as claimed in claim 5, wherein said adhesive gasket is a hot melt type material.

7. The loudspeaker mounting as claimed in 6, wherein said hot melt type material is a polymer based hot melt material.

8. The loudspeaker mounting as claimed in claim 7, wherein said hot melt material is a blend of hydrocarbon polymers, tackifiers and waxes.

9. A loudspeaker housing, comprising:

a housing having an annular flanged rim, said flanged rim including an annular planar portion situated such that the plane defined by said planar portion is substantially perpendicular to the axis of said loudspeaker, an integral flange extending around the periphery of said planar portion;

a sound producing cone suspended from the planar portion of said flanged rim;

driver means mounted on said housing for moving said cone; and an adhesive gasket comprised of hot melt type material and bonded to said annular planar portion, the thickness of said gasket being greater than the height of said flange so that said gasket forms a seal when said loudspeaker is mounted against a baffle.

10. The loudspeaker assembly as claimed in claim 9, further comprising:

a screen adhered to the outside of said gasket by means of the adhesive property of said hot melt type material.

11. In a loudspeaker assembly, having a housing with a flanged rim, a diaphragm suspended from said rim, a driver mounted on said housing coupled to said diaphragm for causing movement of the same to produce sound, an improved padring gasket which comprises:

a ring of hot melt material bonded to said flanged rim.

12. The loudspeaker assembly as claimed in claim 11 further comprising a screen covering the opening of said speaker, said screen being adhered to said padring gasket.

13. A method of attaching a padring gasket to a loudspeaker having a continuous flanged rim, comprising the steps of:

positioning a preformed gasket of hot melt type material on said flanged rim, said gasket being seated on a substantially planar portion of said rim and extending above said flange; and adhering said gasket of hot melt material to said rim by induction heating of said rim.

14. The method of claim 13 further including the step of attaching a screen to said gasket.

15. The method of claim 14 wherein said screen is attached to said gasket by localized heating.

16. The product of claims 13, 14 or 15.

* * * * *